US010786702B2

(12) United States Patent
DeRaimo et al.

(10) Patent No.: US 10,786,702 B2
(45) Date of Patent: Sep. 29, 2020

(54) EXERCISE MAT APPARATUS AND METHOD

(71) Applicant: AG Advisory Group, LLC, Philadelphia, PA (US)

(72) Inventors: Gina-Marie DeRaimo, Philadelphia, PA (US); Alexandra Szakats, New York, NY (US)

(73) Assignee: AG ADVISORY GROUP, LLC, Philadelphia, PA (US)

( * ) Notice: Subject to any disclaimer, the term of this patent is extended or adjusted under 35 U.S.C. 154(b) by 249 days.

(21) Appl. No.: 15/594,726

(22) Filed: May 15, 2017

(65) Prior Publication Data

US 2018/0326253 A1 Nov. 15, 2018

(51) Int. Cl.
*A63B 21/00* (2006.01)
*A63B 71/06* (2006.01)

(52) U.S. Cl.
CPC .... *A63B 21/4037* (2015.10); *A63B 2071/065* (2013.01); *A63B 2071/0694* (2013.01)

(58) Field of Classification Search
CPC ..... A63B 21/40; A63B 2071/06; A63B 71/06; A61H 2201/169
See application file for complete search history.

(56) References Cited

U.S. PATENT DOCUMENTS 1,948,826 A * 2/1934 Peterson ..... A47L 23/24 15/215
6,387,013 B1 5/2002 Marquez
6,420,015 B1 * 7/2002 Nord ..... A47G 27/0231 264/293
D584,093 S 1/2009 Drumm
7,485,071 B2 * 2/2009 Edwards ..... A63B 21/4037 482/23
8,317,660 B2 11/2012 Goranson
8,499,383 B1 8/2013 Ungaro
D699,979 S * 2/2014 Tamayo ..... D6/582
D699,980 S * 2/2014 Tamayo ..... D6/589
D707,057 S * 6/2014 Hasta ..... D6/582
D716,892 S * 11/2014 Schlosser ..... D21/792
8,961,372 B2 2/2015 Hasta
8,966,681 B2 3/2015 Burch
9,211,437 B2 12/2015 Soba
9,241,589 B2 1/2016 Saltzman
D755,304 S * 5/2016 Ackerman ..... D21/662
9,623,277 B2 4/2017 Thompson et al.
(Continued)

*Primary Examiner* — Garrett K Atkinson
(74) *Attorney, Agent, or Firm* — Staniford Tomita LLP

(57) ABSTRACT

The exercise mat system includes an exercise mat consisting of an upper surface with visual markers. The relative positioning of the visual markers correlates to a user's body parts and the distances between the user's body parts. The visual markers accommodate various body shapes and sizes and also accommodate the body changes experienced by a user. The visual markers are represented in different forms, positive space, and negative space so that the user's brain engages the marker's differently depending on which way the user orients his or her body on the mat. The visual markers also serve as measurement device for tracking progress. The symmetry of the mat enables a user to compare and contract movements on each side of his or her body while visually seeing the differences through the relative reference points.

16 Claims, 12 Drawing Sheets

(56) References Cited

U.S. PATENT DOCUMENTS

| | | | | |
|---|---|---|---|---|
| D791,501 | S * | 7/2017 | Nguyen | D21/686 |
| D807,077 | S * | 1/2018 | Springer | D6/582 |
| 2001/0034288 | A1* | 10/2001 | Howlett-Campanella | A63B 21/4037 482/23 |
| 2003/0017915 | A1* | 1/2003 | Prinzmetal | A63B 6/00 482/23 |
| 2007/0066467 | A1* | 3/2007 | Edwards | A63B 21/4037 482/148 |
| 2009/0181836 | A1* | 7/2009 | Schneider | A63B 6/00 482/140 |
| 2009/0297736 | A1* | 12/2009 | Keighley | A47L 23/266 428/12 |
| 2012/0164202 | A1* | 6/2012 | Harris | A47C 31/007 424/404 |
| 2013/0005519 | A1* | 1/2013 | Khan | A63B 59/00 473/565 |
| 2014/0007345 | A1* | 1/2014 | Hasta | A47G 9/062 5/417 |
| 2014/0335319 | A1* | 11/2014 | Tsai | A63B 21/4037 428/172 |
| 2015/0328495 | A1* | 11/2015 | Soba | A63B 21/151 5/417 |
| 2017/0072253 | A1* | 3/2017 | Tsai | B32B 25/10 |
| 2017/0304672 | A1* | 10/2017 | Tsai | A63B 21/4037 |
| 2018/0104529 | A1* | 4/2018 | Aldridge | A63B 21/4037 |
| 2018/0318625 | A1* | 11/2018 | Utman | A63B 6/00 |
| 2018/0353800 | A1 | 12/2018 | Calvaruso | |

* cited by examiner

EXERCISE MAT APPARATUS AND METHOD

BACKGROUND

1. Field

The field relates to exercise mats. Specifically, the exercise mat detailed provides visual reference points to assist the user in finding, learning, and refining their form, improving the consistency of form, and thereby increasing overall efficiency of expended effort and results.

2. Description of the Related Art

Physical therapy is a physical medicine and rehabilitation specialty that, by using mechanical force and movements remediates impairments and promotes mobility, function, and quality of life through examination, diagnosis, prognosis, and physical intervention. Physical therapy management commonly includes the prescription of specific exercises. Additionally, physical therapy works with individuals to prevent the loss of mobility before it occurs by developing fitness and wellness oriented programs for healthier and more active lifestyles.

Conventional exercise mats and fitness center flooring do not provide indications or guidelines for body and limb placement to both teach and achieve proper form and alignment during rehabilitation exercises prescribed in physical therapy, dynamic strength and flexibility development exercises used in wellness routines, and specific exercise styles including yoga, Pilates and martial arts. When done improperly or sub-optimally, exercise reduces the potential results achieved and also increases the risk of injury. What is needed is an exercise mat that improves the alignment and awareness of the user's body and reduces the risk of injury.

SUMMARY OF INVENTION

An exercise mat system can be utilized across modalities of development, wellness and rehabilitation for the purpose of learning optimal alignment for the individual user. The visual markings on the inventive exercise mat enables teachers to facilitate alignment and form education and corrections across students of varying body types and abilities. The user's can learn by seeing their individual alignment reference points. This visual alignment can repeated until the properly aligned exercise is felt internally in the user's body.

In an embodiment, the exercise mat can have a rectangular shape defined by a left edge, a right edge, a front edge and a rear edge. In an embodiment, the visual markings on the mat can include a plurality of longitudinal lines aligned with the length and a plurality of latitudinal lines aligned with the width of the mat. The mat can also include a plurality of visual line markings that are 45 degrees relative to the edges of the mat. In an embodiment, the visual markings can include a plurality of lines and a plurality of parallelogram shapes. The parallelograms can have two 45 degree angles and two 135 degree angles.

The user can perform exercises on the exercise mat in alignment with any of the four edges. By training in all four directions on the mat, the user engages their brain to check against the varying reference point representations.

DETAILED DESCRIPTION

The disclosure that follows is for an exercise mat with includes a visual alignment system with reference points in various representations to engage the brain as the user learns to see their alignment until they learn to feel it internally. The design enables the user to train in all four directions on the mat to keep the brain and body engaged during the learning process.

Figure 1:
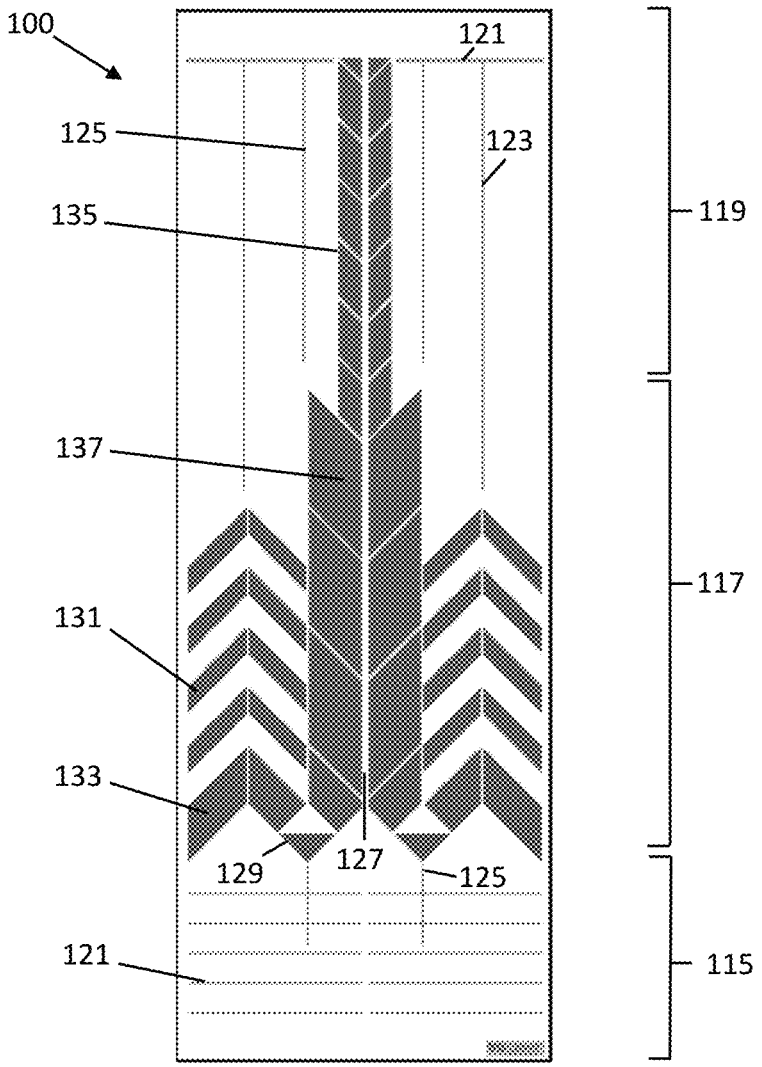
FIG. 1 is the top view of the exercise mat with visual markers.

FIG. 1 is a top view of an embodiment of an exercise mat 100 with visual alignment system. The exercise mat may be constructed of any well-known material. In one form, the exercise mat 100 is made from all natural rubber resulting in a high-grip surface. The exercise mat 100 can be proximately 68 inches long by 24 inches wide or any other suitable dimensions. In the illustrated embodiment, the exercise mat 100 includes visual markers that form primary image of the scorpion 101 and visual markers the which have been named: horizontal line 121, outside lines 123, inside lines 125, spine 127, eyes 129, scorpion legs 131, scorpion claws 133, tail 135, and body 137. In the illustrated embodiments, the scorpion legs 131, scorpion claws 133, tail 135, and body 137 are illustrated as parallelograms with two corners forming 45 degree angles and two corners forming 135 degree angles. The width of the scorpion claw 133 parallelograms can be wider than the scorpion leg 131 parallelograms. The width of the scorpion body 137 parallelograms are wider than tail 135 parallelograms and the scorpion claw 133 parallelograms. The eyes 127 can be squares that are divided into two right triangles. All angles formed by the visual markers are either 90 or 45 degrees relative to the spine 127 center line of the mat 100.

In an embodiment, the top portion 115 of the mat 100 utilizes positive space (ink printed) visual markers, the mid-section 117 of the mat 100 introduces negative space visual markers, and the bottom portion 119 of the mat 100 requires the user to interpolate and infer the visual markers.

The visual markers enable a user to adjust to different markers as his/her body changes over time. Additionally, the design enables persons of different sizes and body abilities to find what is appropriate for his/her specific structure rather than being constrained by a limited set of points that may or may not work for the specific individual using it.

Figure 2:
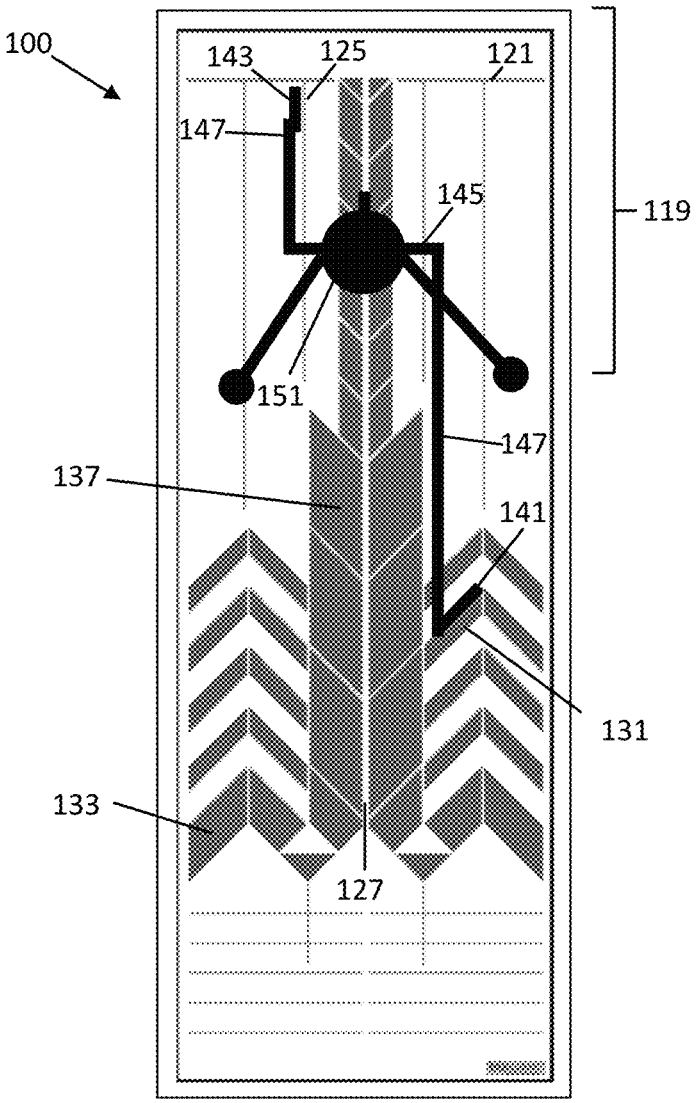
FIG. 2 is the top view of the exercise mat with a first user in warrior 1 pose.
Figure 3:
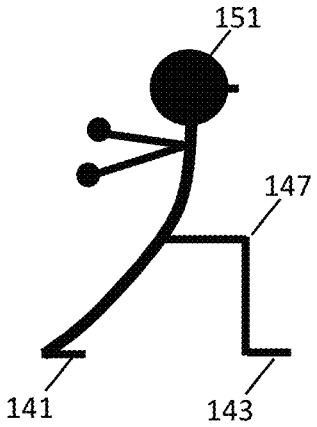
FIG. 3 is the side view of a first user in warrior 1 pose.

FIG. 2 illustrates a top view of a first user 151 performing a "Warrior I Pose" on the mat 100 and FIG. 3 illustrates a profile view of the first user 151 in the Warrior I Pose. The first user 151 can first decide the point of origin for the left foot 143 on the mat 100 and together with his/her instructor the mat 100 is utilized to find and feel the right place for positioning the right foot 141. In this example, the first user 151 is facing the bottom portion 119 of the mat 100 and has placed the left foot 143 adjacent to the inside line 125 of the mat 100 with the toes near the horizontal line 121. The first user 151 has placed the right foot 141 on a scorpion leg 131 which is 45 degrees relative to the inside line 125. The mat 100 markings enables the first user 151 to understand their range of motion by seeing their current alignment abilities against the mat 100 pattern. In this figure, the user has the range of motion to square their hips 145 to the front of the mat 100. The 45 degree angles present in the scorpion legs 131, claws 133 and body segmentation remind the user 139 to track the foot with the direction of the knee.

Figure 4:
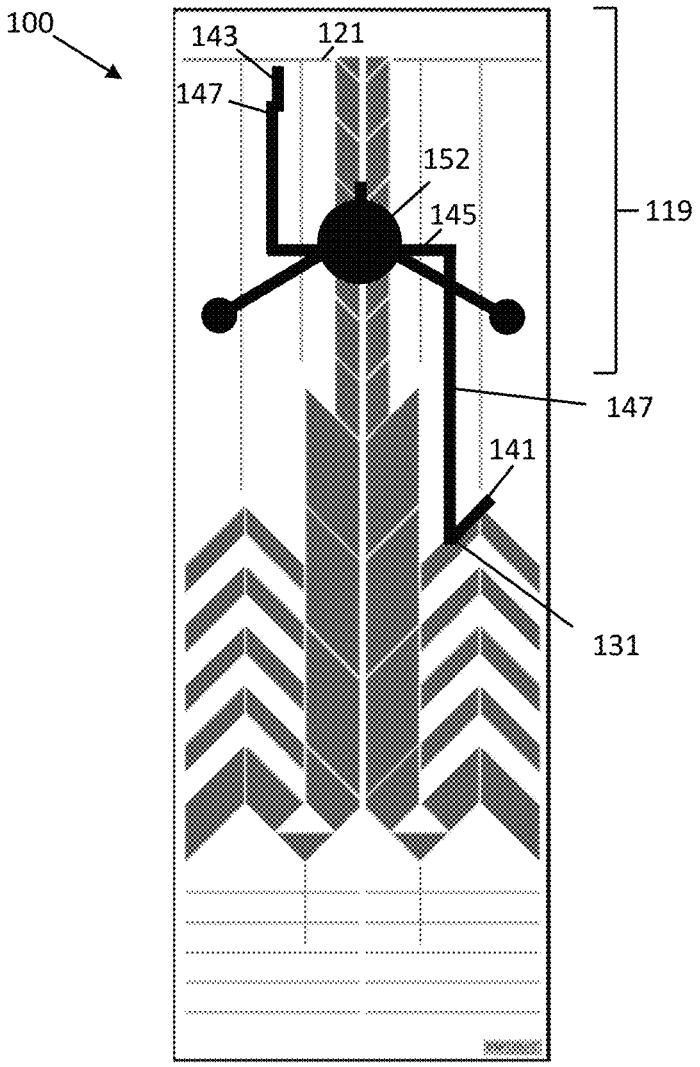
FIG. 4 is the top view of the exercise mat with a second user in warrior 1 pose.

FIG. 4 illustrates another top view of a second user 152 performing a Warrior I Pose on the mat 100. Note this user 139 has different natural preferences when deciding the point of origin for the left foot 143 and together with his/her instructor utilizes the mat 100 to find and feel the right place for positioning the right foot 141 tracking with the knee 147 when the hips 145 are squared toward the bottom portion 119 of the mat 100.

Figure 5:
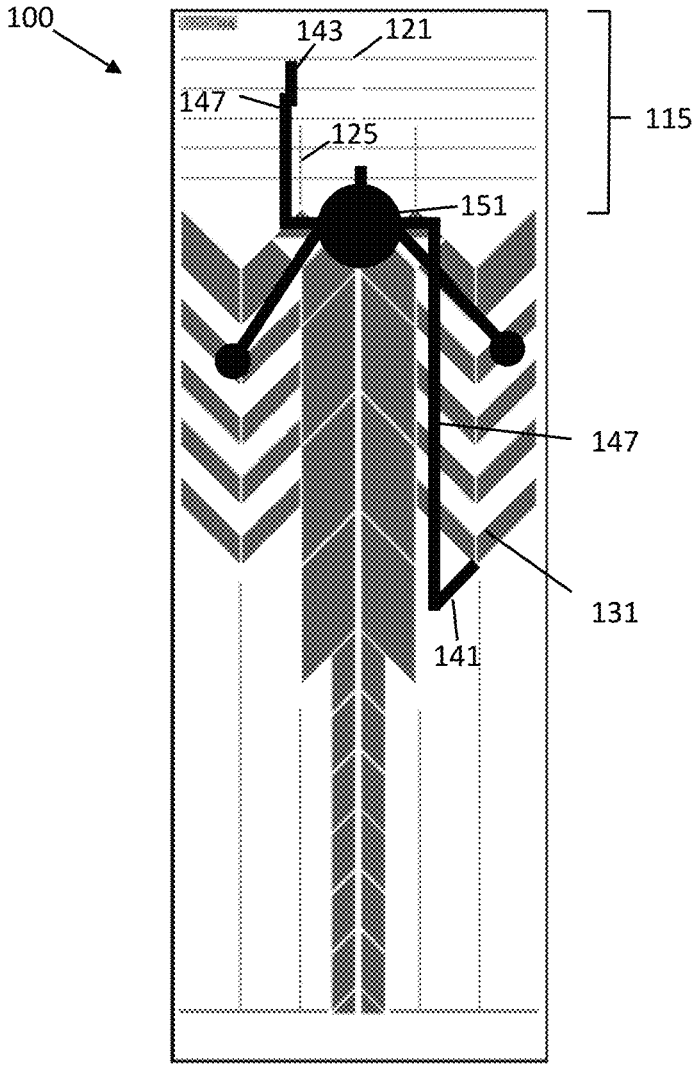
FIG. 5 is the top view of the exercise mat with a first user in warrior 1 facing opposite direction.

FIG. 5 illustrates a first user 151 performing Warrior I Pose facing the front portion 115 of the mat 100. The first user 151 may decide that the point of origin for the left foot 143 is aligned with an inner line 125 with the front of the left foot 143 adjacent to the top horizontal line 121. In this illustration, the first user 151 is using a different visual set of reference points and together with his/her instructor utilizes the mat 100 to find and feel the right place for positioning the right foot 141 tracking with the knee 147 using the 45 degree angles of the scorpion legs 131 as a guide. The first user 151 finds the right foot 141 alignment in negative space aligned with the positive space of the scorpion legs 131. In contrast, with reference to FIGS. 2 and 4, as compared to the right foot 141 alignment in the positive space on the scorpion legs 131 when facing the bottom portion 119 of the mat 100.

Figure 6:
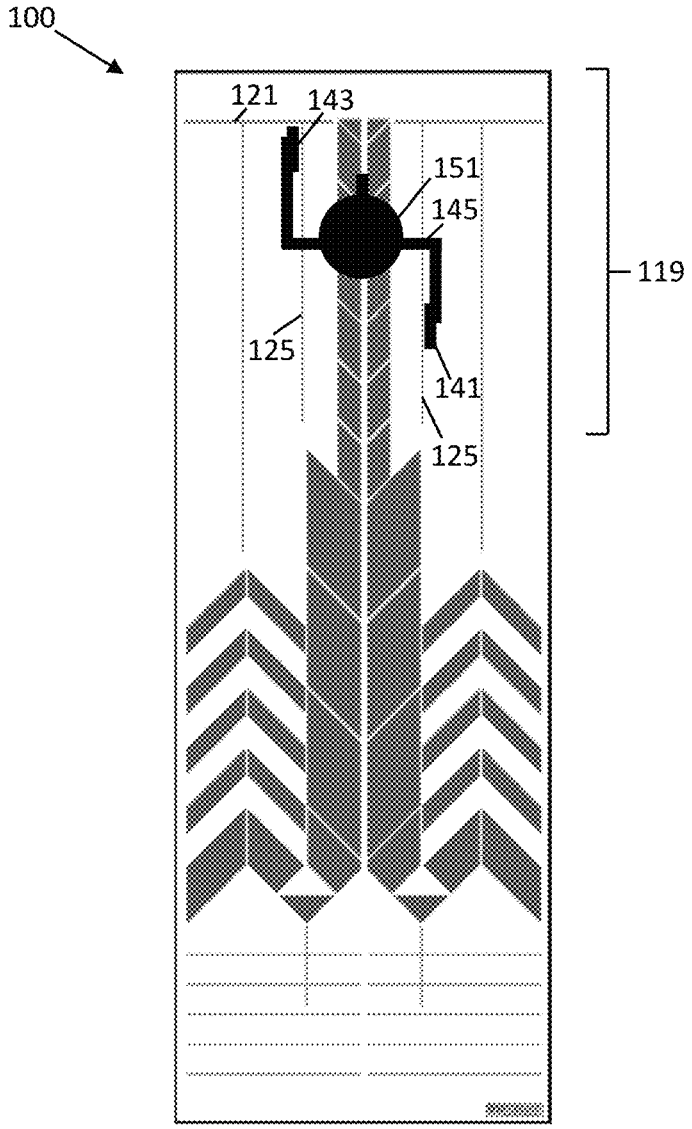
FIG. 6 is the top view of the exercise mat with a first user in kneeling hip flexor stretch.

FIG. 6 illustrates a top view a first user 151 performing a kneeling hip flexor stretch facing the top portion 115 of the mat 100. The first user 151 has placed the left foot 143 is adjacent to the top horizontal line 121 and aligned with the inside lines 125. The right foot 141 is adjacent to the horizontal line 121. The inside lines 125 and other markings on the mat 100 can be seen by the first user 151 and his/her instructor. These mat 100 markings enable the first user 151 to see the positions of the user's hips 145, thighs and calves and find the appropriate parallel alignment.

Figure 7:
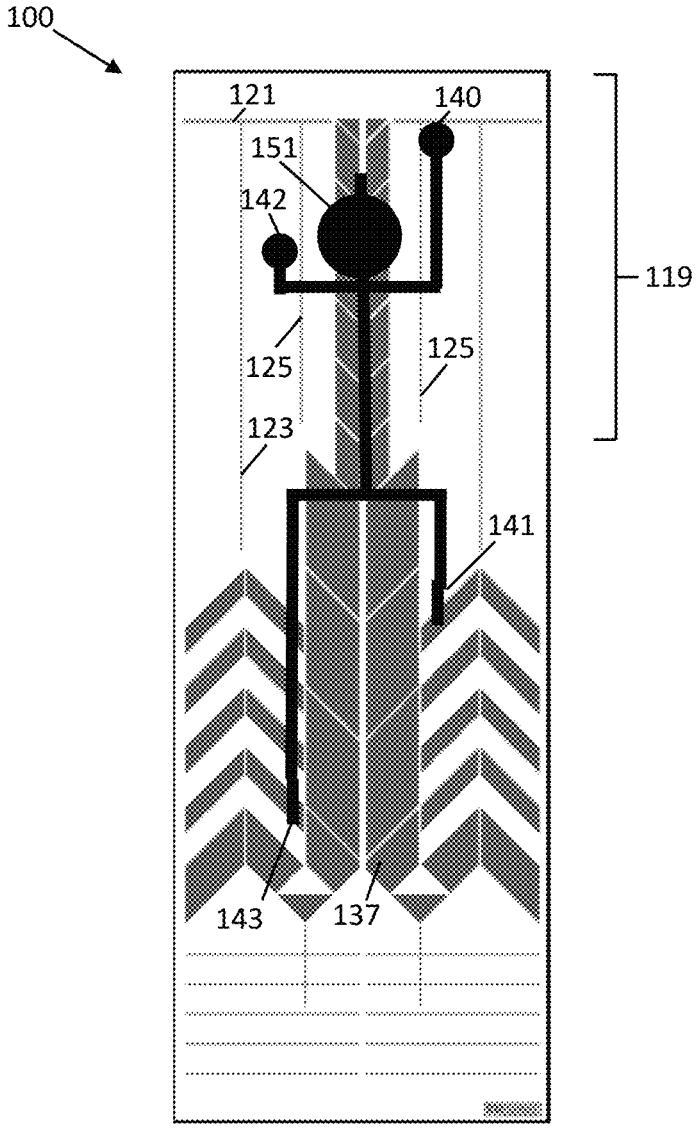
FIG. 7 is the top view of the exercise mat with a first user in quadruped opposite arm/leg.

FIG. 7 illustrates a top view of the first user 151 performing a quadruped opposite arm/leg stretch on facing the bottom portion 119 of the mat 100. The user The mat enables the user to track their spine against the scorpion spine and find the extension stretch in opposite arm/leg while tracking parallel to the vertical lines on the mat.

Figure 8:
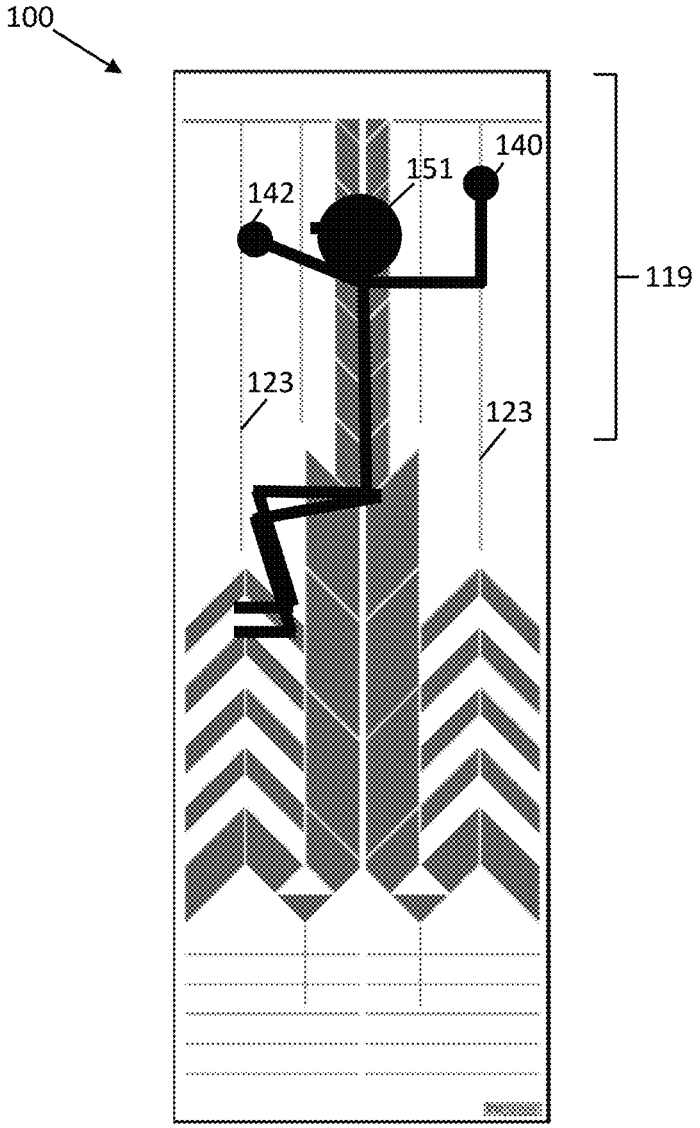
FIG. 8 is the top view of the exercise mat with a first user in supine pectoralis minor stretch.

FIG. 8 illustrates a top view of the first user 151 in supine pectoralis minor stretch. The first user 151 is able to create a 90 degree angle with their right arm by utilizing the vertical lines as a guide, while tracking their torso with the scorpion spine. In this example, the right hand 140 is placed on the outside line 123 with the forearm aligned with the outside line 123 and the elbow creating a 90 degree angle.

Figure 9:
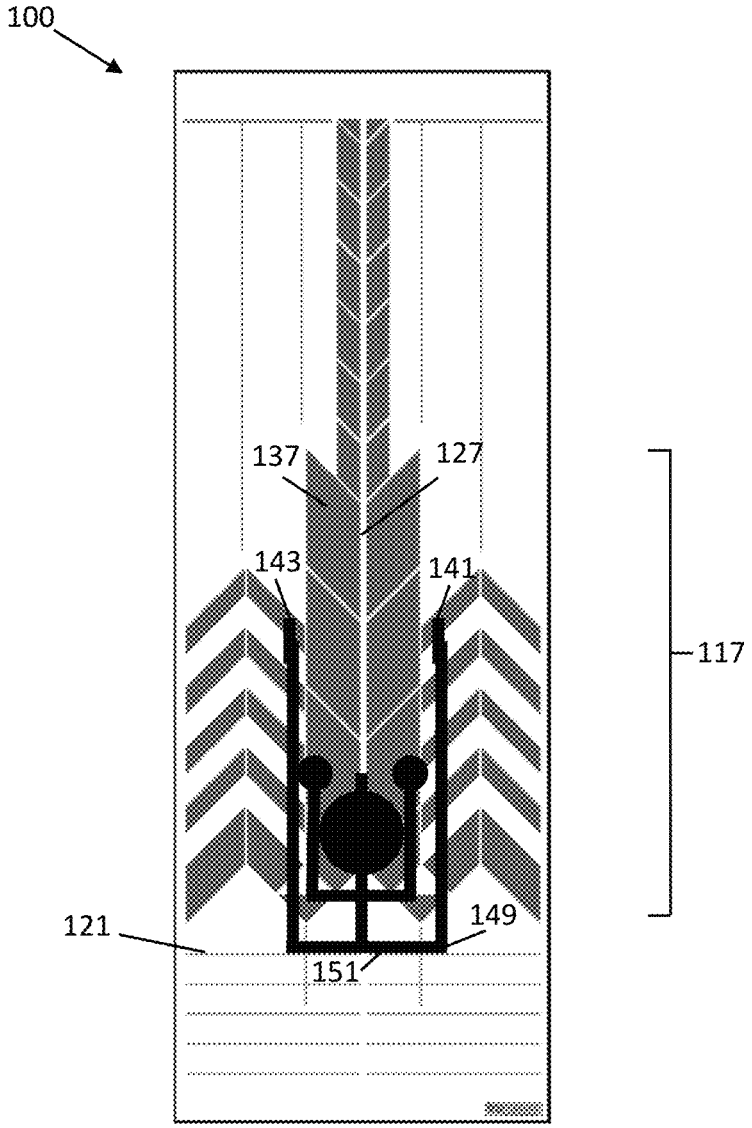
FIG. 9 is the top view of the exercise mat with a first user in seated forward fold.

FIG. 9 illustrates a top view of the first user 151 in a seated forward fold position on a top portion 115 of the mat 100. The first user 151 has chosen to align their sits bones 149 with a horizontal line 121 and utilizes the scorpion spine 127 bisect the first user's 151 body. The left foot 143 and the right foot 141 are aligned and placed on opposite adjacent sides of the scorpion body 137.

Figure 10:
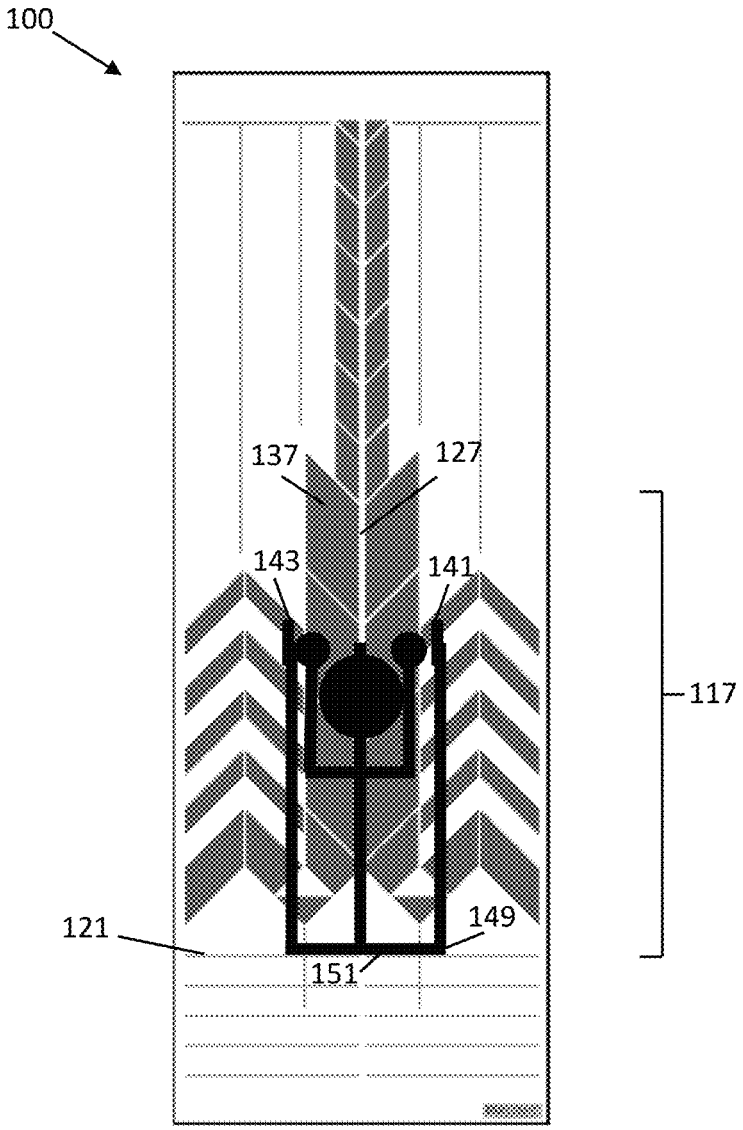
FIG. 10 is the top view of the exercise mat with a first user in seated forward fold, showing measured progress.

FIG. 10 illustrates a top view of the first user 151 in seated forward fold having progressed in the depth of the posture from the seated forward fold position. The progress is visible against the mat pattern and provides both a measurement gauge and reinforcement mechanism for the first user 151 on the mat 100. Again, the first user 151 has chosen to align their sits bones 149 with a horizontal line 121 and utilizes the scorpion spine 127 bisect the first user's 151 body. The left foot 143 and the right foot 141 are aligned and placed on opposite adjacent sides of the scorpion body 137.

Figure 11:
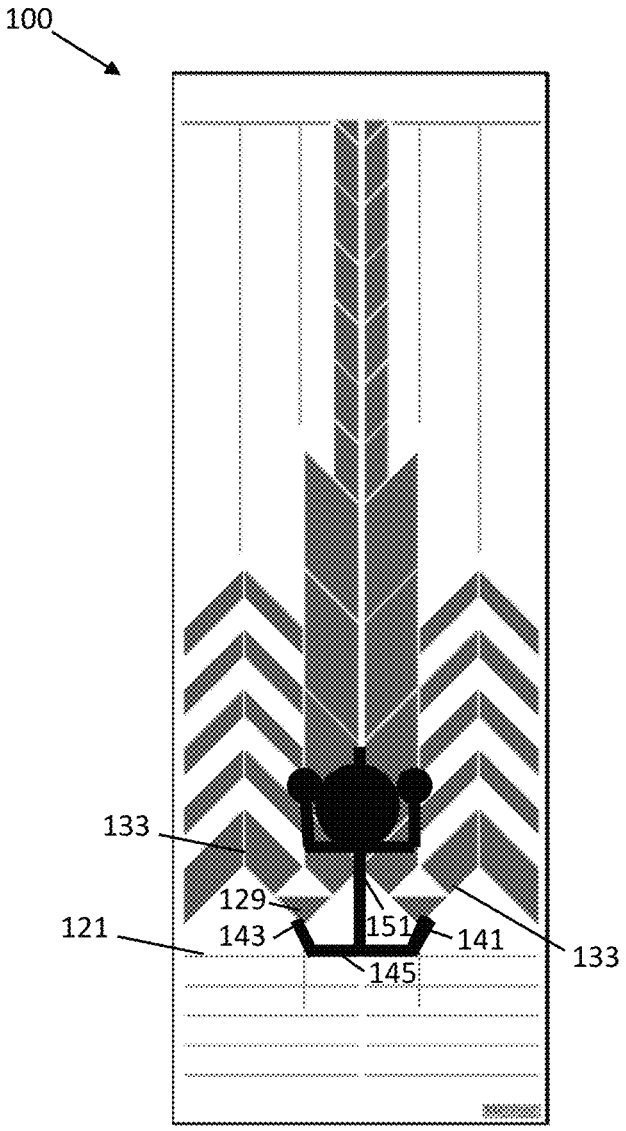
FIG. 11 is the top view of the exercise mat with a first user in standing wide leg forward fold, facing the top of the mat.

FIG. 11 illustrates a top view of the first user 151 in a standing wide leg forward fold, facing the top of the mat 100. The right foot 141, the left foot 143 and the hips 145 are aligned with the horizontal line 121. The right foot 141 and the left foot 143 can track with knees and may be aligned with the 45 degree angles of the scorpion claws 133.

Figure 12:
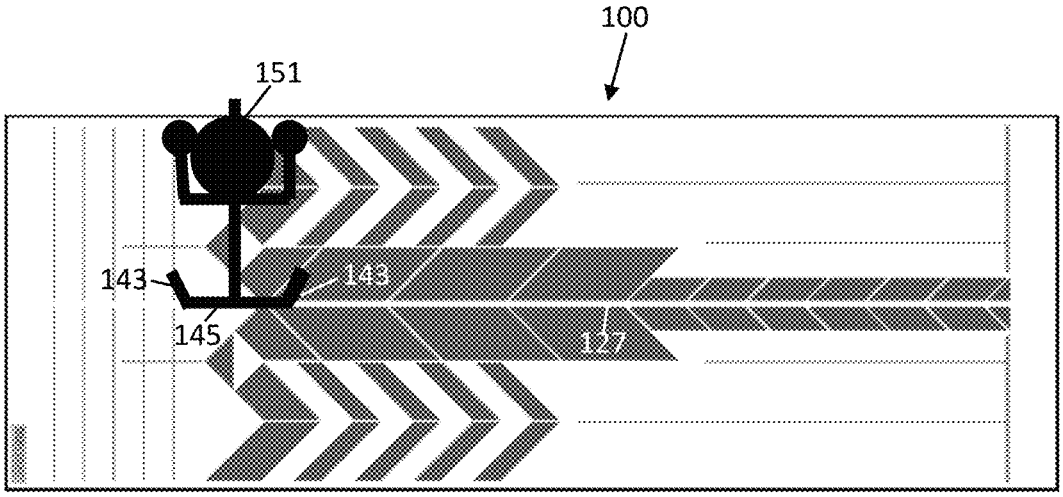
FIG. 12 is the top view of the exercise mat with a first user in standing wide leg forward fold, facing the side of the mat.

FIG. 12 illustrates a top view of the first user 151 in a standing wide leg forward fold, facing the side of the mat 100. In this example, the right foot 141, the left foot 143 and the hips 145 are aligned with the scorpion spine 127. The right foot 141 and the left foot 143 can track with knees.

Figure 13:
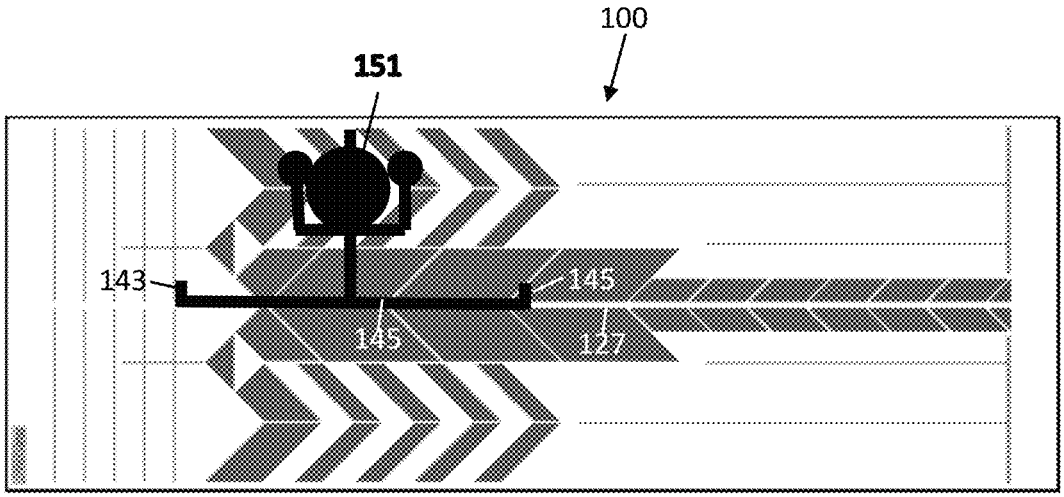
FIG. 13 is the top view of the exercise mat with a first user in standing wide leg forward fold, facing the side of the mat, showing measured progress.

FIG. 13 illustrates a top view of the first user 151 in wide leg forward fold, facing the side of the mat 100, showing measured progress. Hips 145, knees, the right foot 141, and the left foot 143 are aligned to the scorpion spine.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples, and are not meant to be limiting in any way. Other steps and functions may be contemplated without departing from this disclosure or the scope of an embodiment.

What is claimed is:

1. An exercise mat for alignment of a user, comprising:

a top surface of the exercise mat having an alignment system that including a plurality of length line markings aligned with a length of the exercise mat adapted for alignment with a left foot of the user, a plurality of width line markings aligned with a width of the exercise mat on a front side of the exercise mat and adapted for alignment with toes of the left foot of the user, and a plurality of parallelogram markings adapted for alignment with a right foot of the user;

wherein the parallelogram markings include two 45 degree corners and two 135 degree corners, the parallelogram markings form mirrored rows of parallelograms that are symmetric between the left side and a right side of the exercise mat, the parallelogram markings are asymmetric between the front side and a rear side of the exercise mat, the parallelogram markings form a graphical image of a scorpion that includes legs, a body and a tail, a first group of stacked parallelograms that extend along a center line of the length of the mat form the body and the tail, a second group of stacked parallelograms extend across the width of the mat form the legs and the body.

2. The exercise mat of claim 1 wherein the first group of stacked parallelograms markings include six adjacent parallelogram markings and the second group of stacked parallelograms markings include nine adjacent parallelogram markings.

3. The exercise mat of claim 1 wherein the plurality of width line markings are adjacent to the front side of the exercise mat.

4. The exercise mat of claim 1 wherein the plurality of length line markings do not extend across the entire length from the top side to the bottom side of the exercise mat.

5. The exercise mat of claim 1 wherein the plurality of the parallelogram markings are adjacent to each other.

6. The exercise mat of claim 5 wherein some of the plurality of the parallelogram markings extend across the width from the left side to the right side of the exercise mat.

7. The exercise mat of claim 1 further comprising:

a plurality of reference points that are adapted to correlate to positions of a user's body parts.

8. An exercise mat for alignment of a user, comprising:

a top surface of the exercise mat having an alignment system that including a plurality of length line markings aligned with a length of the exercise mat adapted for alignment with a left foot of the user, a plurality of width line markings aligned with a width of the exercise mat on a front side of the exercise mat and adapted for alignment with toes of the left foot of the user, and a plurality of parallelogram markings include two 45 degree corners and two 135 degree corners, and the parallelogram markings are asymmetric between a front side and a rear side of the exercise mat;

wherein a group of adjacent parallelograms extend across the width of the exercise mat on the rear side of the mat for adapted alignment with a right foot of the user and the group of adjacent parallelograms do not extend across the width of the exercise mat on the front side of the mat opposite the rear side of the mat, the parallelogram markings are symmetric between the left side and a right side of the exercise mat, the parallelogram markings are asymmetric between the front side and a rear side of the exercise mat, the parallelogram markings form a graphical image of a scorpion that includes legs, a body and a tail, a first group of stacked parallelograms that extend along a center line of the length of the mat form the body and the tail, a second group of stacked parallelograms extend across the width of the mat form the legs and the body.

9. The exercise mat of claim 8 further comprising:

a graphical image formed from the plurality of parallelograms, wherein the graphical image is aligned with a center line along the length of the exercise mat and symmetric between a right side and a left side of the exercise mat.

10. The exercise mat of claim 9 wherein the graphical image is a scorpion that includes eye, claws, legs, and a body that are on a rear side of the mat and a tail that is on a front side of the mat.

11. The exercise mat of claim 9 further comprising:

a plurality of reference points that are adapted to correlate to positions of a user's body parts.

12. An exercise mat system for alignment of a user, comprising:

a foam material having a rectangular shape with a left side, a right side, a rear side and a front side;

a top surface of the exercise mat having an alignment system that including a plurality of length line markings aligned with a length of the exercise mat adapted for alignment with a left foot of the user, a plurality of width line markings aligned with a width of the exercise mat on a front side of the exercise mat and adapted for alignment with toes of the left foot of the user, and a plurality of parallelogram markings include two 45 degree corners and two 135 degree corners, and the parallelogram markings are asymmetric between a front side and a rear side of the exercise mat;

wherein a group of adjacent parallelograms extend across the width of the exercise mat on the rear side of the mat for adapted alignment with a right foot of the user and the group of adjacent parallelograms do not extend across the width of the exercise mat on the front side of the mat opposite the rear side of the mat, the parallelogram markings are symmetric between the left side and a right side of the exercise mat, the parallelogram markings are asymmetric between the front side and a rear side of the exercise mat, the parallelogram markings form a graphical image of a scorpion that includes legs, a body and a tail, a first group of stacked parallelograms that extend along a center line of the length of the mat form the body and the tail, a second group of stacked parallelograms extend across the width of the mat form the legs and the body.

13. The exercise mat of claim 12 wherein the plurality first group of stacked parallelograms markings include six adjacent parallelogram markings and the second group of stacked parallelograms markings include nine adjacent parallelogram markings.

14. The exercise mat of claim 12 wherein the plurality of width line markings are adjacent to the front side of the exercise mat.

15. The exercise mat of claim 12 wherein the plurality of length line markings do not extend across the entire length from the top side to the bottom side of the exercise mat.

16. The exercise mat of claim 12 further comprising:

a plurality of reference points that are adapted to correlate to positions of a user's body parts.

* * * * *